US007422036B2

(12) United States Patent
Burrows et al.

(10) Patent No.: US 7,422,036 B2
(45) Date of Patent: Sep. 9, 2008

(54) DISHWASHER MANIFOLD ASSEMBLY AND ASSOCIATED METHOD

(75) Inventors: James Burrows, Winterville, NC (US); Doug Nagel, Kinston, NC (US); John Bragg, Goldsboro, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 89 days.

(21) Appl. No.: 11/460,876

(22) Filed: Jul. 28, 2006

(65) Prior Publication Data

US 2008/0023095 A1 Jan. 31, 2008

(51) Int. Cl.
*F16L 9/16* (2006.01)

(52) U.S. Cl. ..... 138/157; 138/156; 138/164; 138/128

(58) Field of Classification Search ..... 138/157, 138/158, 162, 163, 159, 164, 128, 156; 156/304.2, 156/304.5; 134/198
See application file for complete search history.

(56) References Cited

U.S. PATENT DOCUMENTS

| | | | | | |
|---|---|---|---|---|---|
| 773,945 | A | * | 11/1904 | Kronauer | 138/158 |
| 1,014,549 | A | * | 1/1912 | Wilson | 405/48 |
| 2,005,699 | A | * | 6/1935 | Gottwald | 285/61 |
| 3,204,668 | A | * | 9/1965 | Emerson, Jr. et al. | 138/158 |
| 3,415,259 | A | | 12/1968 | Noren et al. | 134/180 |
| 3,728,746 | A | | 4/1973 | Konen et al. | 4/696 |
| 4,462,556 | A | * | 7/1984 | Graham, Jr. | 242/118.31 |
| 4,733,800 | A | * | 3/1988 | Bjorkengren et al. | 222/107 |
| 4,940,614 | A | * | 7/1990 | Kastl et al. | 428/34.8 |
| 4,942,907 | A | * | 7/1990 | Joh et al. | 138/157 |
| 4,967,800 | A | * | 11/1990 | Heilmayr et al. | 138/162 |
| 5,267,582 | A | | 12/1993 | Purtilo | 134/180 |
| 5,429,485 | A | | 7/1995 | Dodge | 417/442 |
| 5,542,711 | A | | 8/1996 | Vaudry | 285/41 |
| 6,026,846 | A | | 2/2000 | Wolf et al. | 137/375 |
| 6,089,279 | A | * | 7/2000 | Clarke et al. | 138/157 |
| 6,117,380 | A | | 9/2000 | Shirai et al. | 264/250 |
| 6,247,500 | B1 | * | 6/2001 | McMahon | 138/157 |
| 6,644,338 | B1 | | 11/2003 | Campau | 137/260 |
| 6,712,082 | B2 | * | 3/2004 | Crane et al. | 134/108 |
| 6,773,587 | B2 | | 8/2004 | Kool et al. | 210/232 |
| 2004/0025955 | A1 | * | 2/2004 | Skinner et al. | 138/157 |
| 2004/0113327 | A1 | | 6/2004 | Starita | 264/506 |

(Continued)

FOREIGN PATENT DOCUMENTS

| | | |
|---|---|---|
| CN | 2 794 789 Y | 7/2006 |

(Continued)

*Primary Examiner*—Patrick F Brinson
(74) *Attorney, Agent, or Firm*—Alston & Bird LLP

(57) ABSTRACT

A tubular manifold device for a dishwasher and associated method are provided. The manifold device defines a contiguous interior channel between opposed inlet and outlet ends. The manifold device has an inner surface defining the interior channel and an opposing outer surface, and comprises at least two discretely-formed manifold portions, each extending between and at least bisecting the opposed inlet and outlet ends of the interior channel. The at least two manifold portions are capable of cooperating via respective engagable longitudinal edges so as to form at least two joints therebetween. At least one overmold member is configured to sealingly engage the at least two manifold portions, across each of the at least two joints, such that the interior channel is fluid-tight between the inlet and outlet ends.

11 Claims, 5 Drawing Sheets

U.S. PATENT DOCUMENTS

Figure 1:
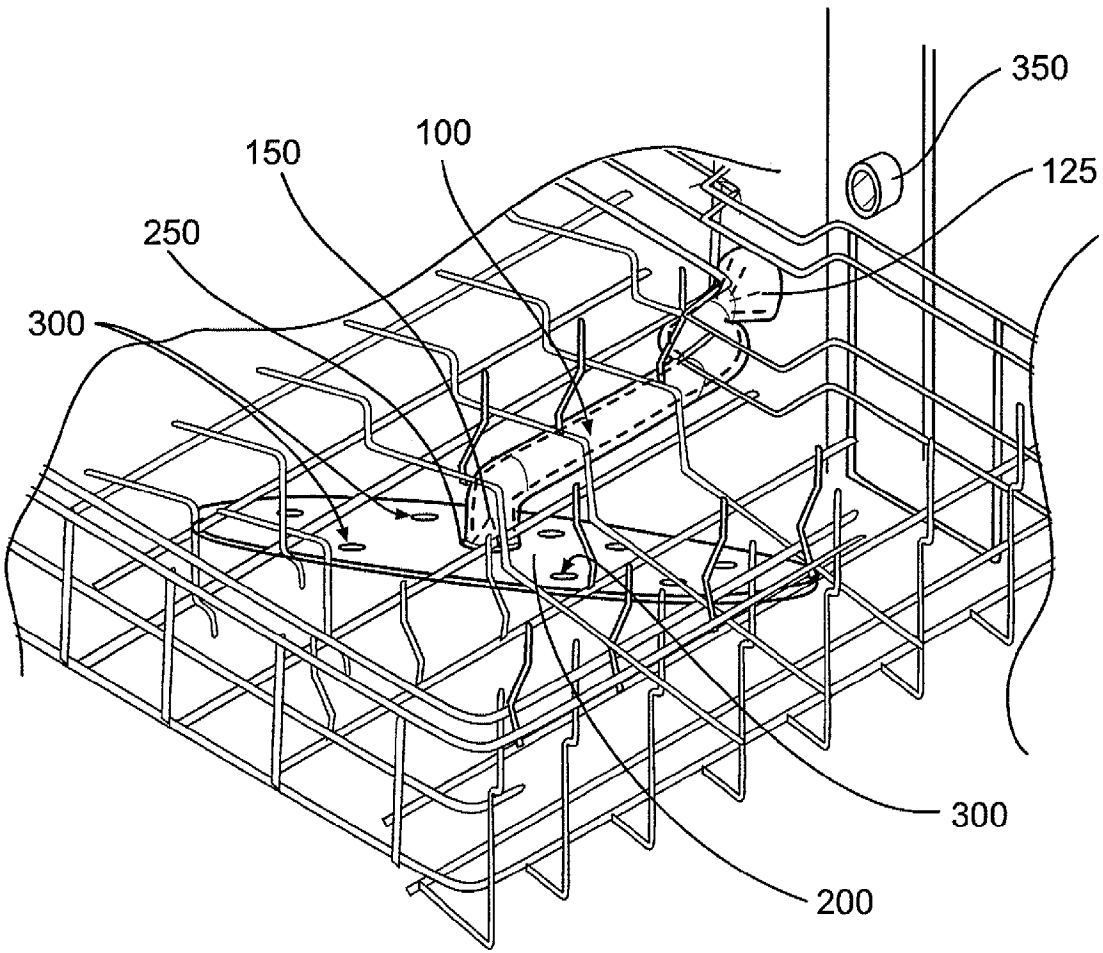

| | | | | |
|---|---|---|---|---|
| 2005/0039801 | A1 | 2/2005 | Rhodes | 137/606 |
| 2005/0211278 | A1* | 9/2005 | Favaro et al. | 134/56 D |
| 2005/0241680 | A1* | 11/2005 | Noh | 134/56 D |
| 2006/0185700 | A1* | 8/2006 | Lee | 134/198 |

FOREIGN PATENT DOCUMENTS

| | | | |
|---|---|---|---|
| FR | 2 802 851 | A | 6/2001 |

* cited by examiner

DISHWASHER MANIFOLD ASSEMBLY AND ASSOCIATED METHOD

BACKGROUND OF THE INVENTION

1. Field of the Invention

The present invention relates to dishwashers and, more particularly, to a dishwasher manifold device and associated method.

2. Description of Related Art

A manifold device for a dishwasher is generally configured to deliver the dishwashing fluid from a fluid delivery tube to a central port of a spray arm medially disposed within the dishwashing compartment. In such instances, the fluid delivery tube is typically configured to extend along a wall of the dishwashing compartment, while the spray arm is configured to rotate about the central port having a vertical axis extending therethrough. Accordingly, the manifold assembly is configured to deliver the dishwashing fluid from the fluid delivery tube disposed about a wall of the dishwashing compartment, to a medial location within the dishwashing compartment such that the dishwashing fluid is delivered to the central port of the spray arm.

In some instances, such manifold devices may be manufactured as a one-piece assembly using, for example, an injection molding process. However, such a one-piece molding process generally requires, for example, a physical slide or core for defining the interior channel of the manifold device. In this manner, such a slide or core must be removed from the molded piece, once the manifold device is molded over the slide/core, in order to form the interior channel of the manifold device. However, the requirement for the slide/core for forming the interior channel of the manifold device in the molding process thereof, as well as the requirements for inserting the slide/core prior to formation and extracting the slide/core following formation, may limit the efficiency and/or the hydrodynamic configuration of the manifold device. For instance, such a manifold device is typically configured to deliver the dishwashing fluid from the generally main fluid delivery tube laterally across a portion of the dishwasher and then into the generally vertically-oriented central port of the spray arm, thereby requiring a 90° bend or elbow to direct the dishwashing fluid into the central port. In such instances, the one-piece injection molding process may not necessarily provide the appropriate radius (or radii) of the turn in the manifold necessary to provide optimum delivery of the dishwashing fluid to the spray arm.

In other instances, such a manifold device, comprised of a polymeric material, may be formed in multiple portions and then joined together to form the manifold device. The multiple portions may be longitudinally- or laterally-disposed with respect to each other, and the joining process may be accomplished, for example, using a sonic welding or vibration welding process. However, such welding processes may experience, for example, difficulty in maintaining a consistent weld along the joint seam between adjacent portions of the manifold device. Further, such sonic welding or vibration welding processes may tend to displace material forming the manifold portions from the joint seam, which may reduce the wall thickness of the manifold device at or about the joint seam.

Thus, there exists a need for a dishwasher manifold device and associated method for forming such a dishwasher manifold device, capable of providing increased flexibility in the configurations of a manifold device, while simplifying tooling requirements for manufacturing such a manifold device. It would be further desirable for the resulting manifold device to be consistently fluid-tight, with a consistent wall thickness even at or about any seams in the assembly of the manifold device.

BRIEF SUMMARY OF THE INVENTION

The above and other needs are met by the present invention which, in one embodiment, provides a tubular manifold device for a dishwasher. Such a manifold device defines a contiguous interior channel between opposed inlet and outlet ends. The manifold device has an inner surface defining the interior channel and an opposing outer surface, and comprises at least two discretely-formed manifold portions, each extending between and at least bisecting the opposed inlet and outlet ends of the interior channel. The at least two manifold portions are capable of cooperating via respective engagable longitudinal edges so as to form at least two joints therebetween. At least one overmold member is configured to sealingly engage the at least two manifold portions, across each of the at least two joints, such that the interior channel is fluid-tight between the inlet and outlet ends.

Another aspect of the present invention comprises a method of forming a tubular manifold device for a dishwasher, wherein the manifold device has opposed inlet and outlet ends and defining a contiguous interior channel therebetween. The manifold device further includes an inner surface defining the interior channel and an opposing outer surface. Such a method comprises operably engaging respective longitudinal edges of at least two discretely-formed manifold portions, with each manifold portion extending between and at least bisecting the opposed inlet and outlet ends of the interior channel, so as to form at least two joints therebetween. At least one overmold member is sealingly engaged with each of the at least two manifold portions, across each of the at least two joints, such that the interior channel is fluid-tight between the inlet and outlet ends.

Embodiments of the present invention this provide significant advantages as disclosed herein in further detail.

BRIEF DESCRIPTION OF THE SEVERAL VIEWS OF THE DRAWING(S)

Having thus described the invention in general terms, reference will now be made to the accompanying drawings, which are not necessarily drawn to scale and which do not necessarily illustrate actual geometries, and wherein:

FIG. 1 schematically illustrates a manifold device for a dishwasher according to one embodiment of the present invention, the manifold device extending from a main fluid delivery tube to a rotating spray arm;

FIGS. 2A-2E schematically illustrate embodiments of a manifold device for a dishwasher according to the present invention, wherein the at least two discretely-formed manifold portions cooperate via respective engagable longitudinal edges so as to form at least two joints therebetween, and wherein at least one overmold member is configured to sealingly engage the at least two manifold portions, across each of the at least two joints, such that the interior channel is fluid-tight between the inlet and outlet ends.; and FIGS. 3A-3E schematically illustrate alternate embodiments of a manifold device for a dishwasher according to the present invention, wherein the at least two discretely-formed manifold portions cooperate via respective engagable longitudinal edges so as to form at least two joints therebetween, and wherein at least one overmold member is configured to sealingly engage the at least two manifold portions, across each of the at least two joints, such that the interior channel is fluid-tight between the inlet and outlet ends.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 schematically illustrates a manifold device for a dishwasher according to one embodiment of the present invention, the manifold device being generally indicated by the numeral 100. Such a manifold device 100 defines an interior channel 75 (see, e.g., FIGS. 2A and 3A) and is generally used to feed and direct a dishwashing fluid (not shown) therethrough to a spray arm mechanism 200 that rotates within the dishwasher to distribute the dishwashing fluid over dishware contents within the dishwasher. That is, a rotating spray arm mechanism 200 in a dishwasher is typically fed the dishwashing fluid at a central port 250 thereof, wherein the dishwashing fluid entering the central port 250 of the spray arm mechanism 200 from an outlet end 150 of the interior channel 75 of the manifold device 100 causes the spray arm mechanism 200 to rotate about the central port 250. The dishwashing fluid entering the interior of the spray arm mechanism 200 through the central port 250 is then dispensed onto the dishware contents through a series of perforations/nozzles 300 extending along the length of the spray arm mechanism 200. The dishwashing fluid is typically fed to the central port 250 of the spray arm mechanism 200, through the interior channel 75 of the manifold device 100, from a main fluid delivery tube 350 in the dishwasher, with the manifold device 100 extending from an inlet end 125 cooperating with the fluid delivery tube 350 and through the interior channel 75 to the outlet end 150 cooperating with the central port 250 of the spray arm mechanism 200.

In some instances, the fluid delivery tube 350 is configured to extend generally vertically along a wall of the dishwashing compartment, while the spray arm mechanism 200 is configured to rotate about the central port 250. That is, the central port 250 generally has a vertical axis extending therethrough in lateral displacement from the vertical wall of the dishwasher. Such a dishwasher further comprises one or more racks for supporting the dishware contents, wherein such racks are often configured to maximize the capacity of the dishwasher with respect to the dishware contents. In some instances, in order to conform to the particular capacity-maximizing configuration of the racks, the manifold device 100 may be required to traverse a non-linear path between the fluid delivery tube 350 and the central port 250. Accordingly, the manifold device 100 may be required to include various changes of direction along the length thereof. That is, the manifold device 100 may be required to include, for example, various curves, changes in the dimensions and/or shape of the cross-section, reinforcements, and/or reliefs in high stress locations. However, while meeting the rack configuration requirements, the manifold device 100 may also be required to provide particular flow characteristics for delivering the dishwashing fluid through the interior channel 75 to the central port 250 of the spray arm mechanism 200.

As shown in FIG. 2A-2D, embodiments of the present invention are thus directed to a manifold device 100 constructed of two or more individually-molded portions 100A, 100B, wherein the portions 100A, 100B are connected together to form respective fluid-tight joints 400 by one or more overmold members 450, thereby defining the interior channel 75. Though FIGS. 2A-2E and 3A-3E illustrate a manifold device 100 comprising two individually-molded portions 100A, 100B, one skilled in the art will appreciate that such manifold device 100 may be comprised of three or more such individually-molded portions as necessary or desirable. In one embodiment, the manifold device 100 may be individually molded as two separate longitudinal portions 100A, 100B, wherein the two separate longitudinal portions 100A, 100B are capable of cooperating to define the interior channel 75 therebetween. That is, in some embodiments, each longitudinal portion 100A, 100B extends from and at least bisects the inlet and outlet ends 125, 150 of the manifold device 100 such that the interior channel 75 is longitudinally divided. In such instances, each portion 100A, 100B of the manifold device 100 can be individually molded with the desirable and/or required characteristics of the interior channel 75 such as, for example, the appropriate radius (simple or complex) of any bends, curves, elbows; suitable changes in cross-section dimension or shape; or any desired reinforcement or relief.

In one instance, the interior channel 75 may include an arcuate portion about the outlet end 175, particularly where the manifold device 100 turns to direct the dishwashing fluid into the central port 250 of the spray arm mechanism 200. In such instances, a particular geometry of the interior channel 75 may be required in order to facilitate desirable flow characteristics of the dishwashing fluid into the spray arm mechanism 200. For instance, the arcuate portion of the interior channel 75 may be configured to have a variable radius (or radii) or a substantially constant radius, as appropriate. When configured in an appropriate manner, the physical characteristics of the arcuate portion may facilitate a reduction of the pressure drop in the flow of the dishwashing fluid, as the dishwashing fluid is directed through the arcuate portion and into the central port 250 of the spray arm mechanism 200. By reducing the pressure drop, a more efficient transfer (and thus a higher pressure flow) of the dishwashing fluid into the spray arm mechanism 200 will result, thereby providing a higher pressure spray capability of the dishwashing fluid through the series of perforations/nozzles 300 (spray jets) extending along the length of the spray arm mechanism 200. One skilled in the art will appreciate, however, that any such turns or arcuate portions of the interior channel 75 (as shown, for example, in FIGS. 1, 2A, 2B, 3A, and 3B) can be configured to optimize flow (reduce pressure drops) of the dishwashing fluid therethrough on an optional basis. That is, any such turns or arcuate portions, none of the turns/arcuate portions, or all of the turns/arcuate portions may be configured for particular flow characteristics, as necessary or desired.

Once the configuration of the manifold device 100 is determined, the molding process for the multi-piece manifold device 100 may be accomplished, for example, using an injection molding process. However, one skilled in the art will appreciate that many different formation processes may be implemented as necessary and/or desirable, wherein such processes may include, for example, molding, casting, stamping, or any other suitable process. In instances where an injection molding process is used, manufacturing of the individual portions 100A, 100B is facilitated and formation of the manifold device 100 is simplified by requiring, for example, only a straight pull tool device (i.e., complementary male/female mold portions) for molding each portion 100A, 100B. In one instance, the individual portions 100A, 100B may be simultaneously molded using a single molding device (not shown). For example, where the manifold device 100 includes two individual portions 100A, 100B, the molding device may include two opposing female mold portions with a single male/male mold insert disposed therebetween. Such a configuration of a molding device thereby allows both individual portions 100A, 100B to be molded in one process. One skilled in the art will further appreciate that such a single molding device may also be adapted to instances in which the manifold device 100 is divided into three or more individual portions, and that the examples disclosed herein are not intended to be limiting in this respect. According to one aspect of the present invention, the individual portions 100A, 100B of the manifold device 100 may be molded from a thermoplastic elastomer such as, for example, a polypropylene material, and may optionally include a filler material such as, for example, a calcium carbonate, glass, talc, and/or any other suitable filler material.

Figure 2B:
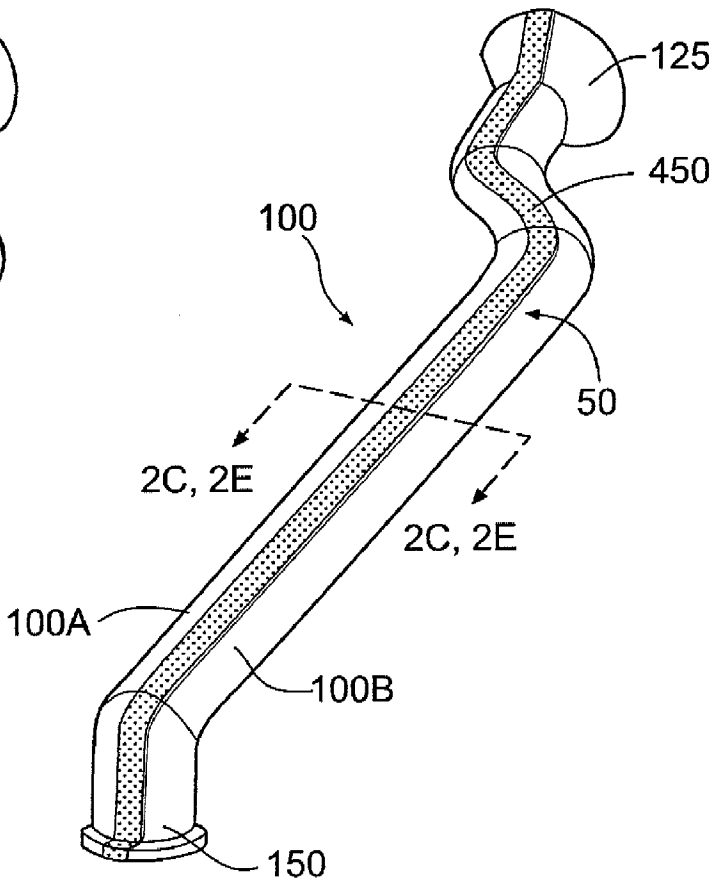
Figure 2A:
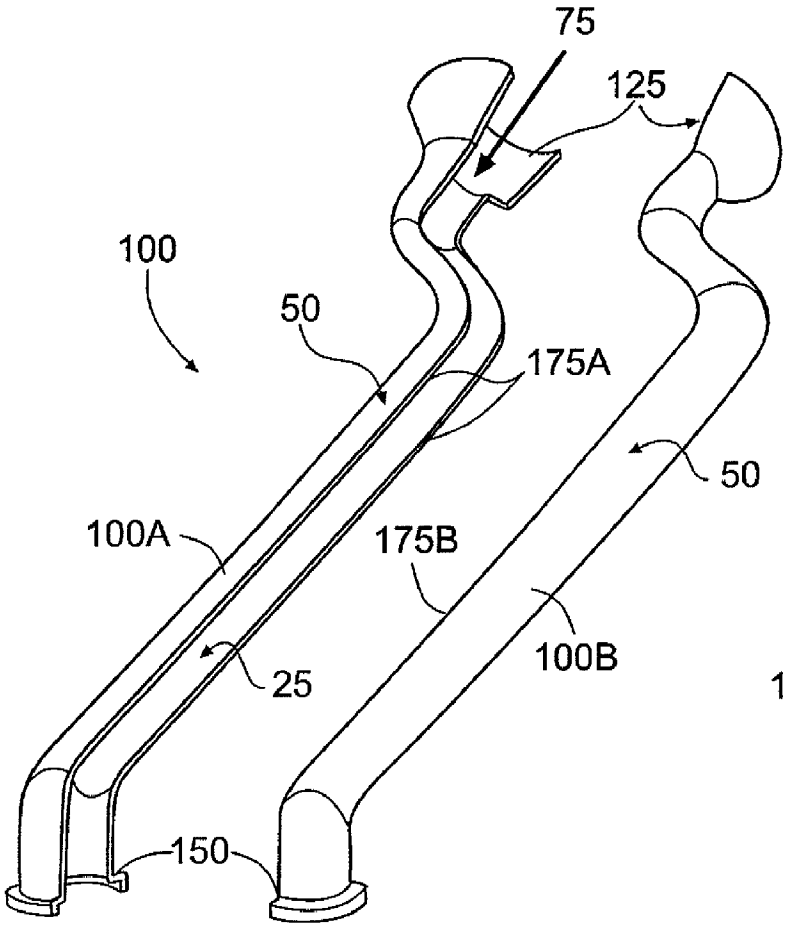
Figure 2D:
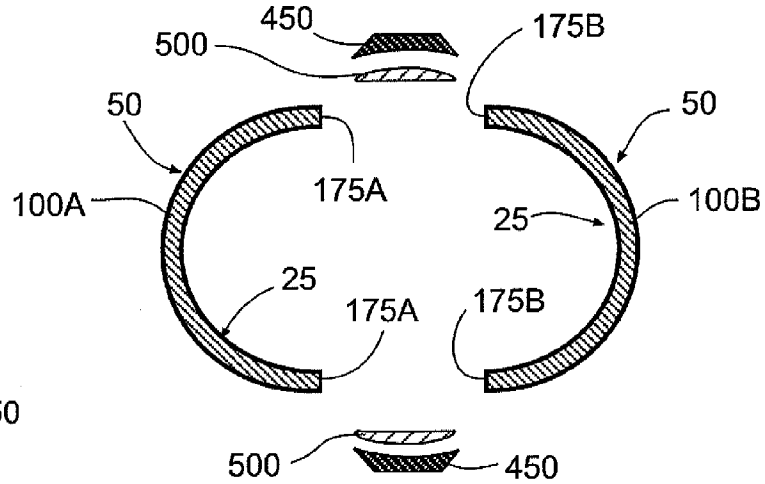
Figure 2E:
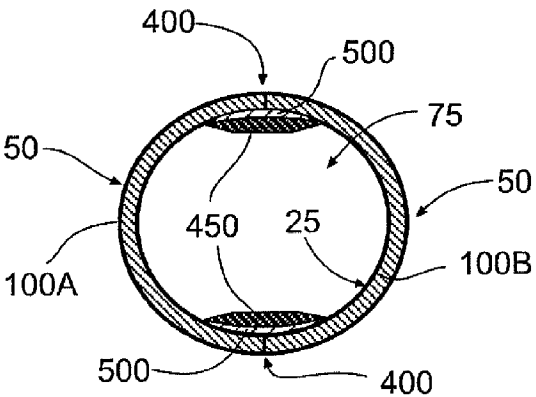
Figure 2C:
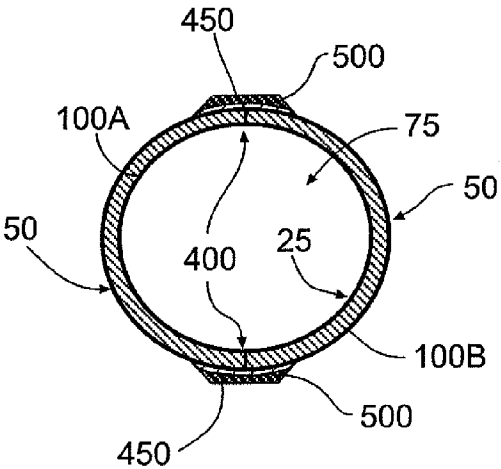

Once the individual portions 100A, 100B of the manifold device 100 are molded, the portions 100A, 100B are then connected or otherwise joined together, as shown in FIGS. 2B, 2C, 2E, 3B, 3C, and 3E, to form respective fluid-tight joints 400 using, for example, one or more overmold members 450. For example, the two portions 100A, 100B of the manifold device 100 may each have complementary pairs of longitudinal edges 175A, 175B, respectively, as shown in FIGS. 2A and 2C-2E. The longitudinal edges 175A, 175B may be configured, for example, to form butt joints, as shown in FIGS. 2B, 2C, and 2E. In such instances, the butt joints may be overlaid, for example, by one or more appropriate overmold members 450 configured to sealingly engage each of the portions 100A, 100B across each butt joint to thereby form the fluid-tight joints 400 between the inlet and outlet ends 125, 150. That is, an overmold member 450 covers each seam (i.e., in a "laid over" configuration) formed by the longitudinal edges 175A, 175B. The overmold member 450 may be applied, for example, to an external surface 50 of the manifold device 100, as shown in FIG. 2C and/or an internal surface 25 (i.e., the wall of the manifold device 100 defining the interior channel 75), as shown in FIG. 2E.

Figure 3B:
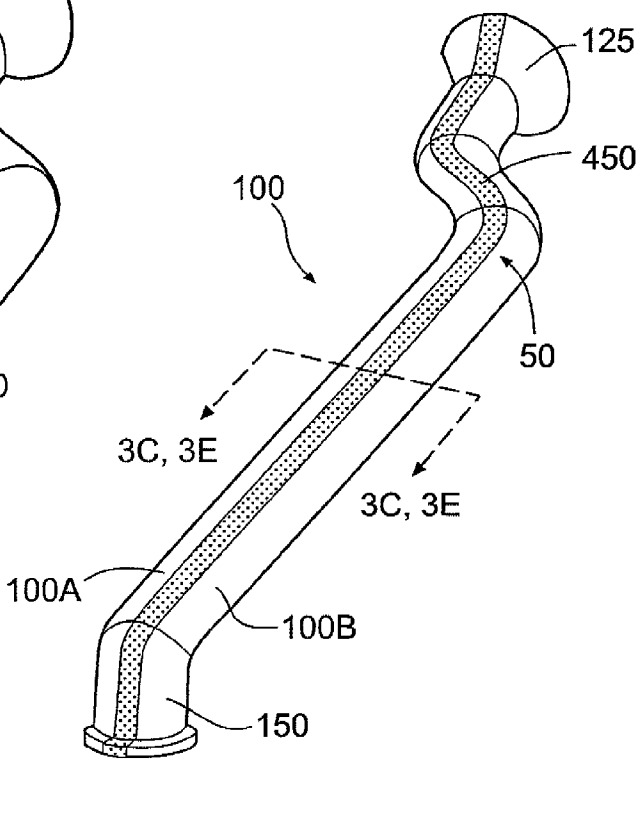
Figure 3A:
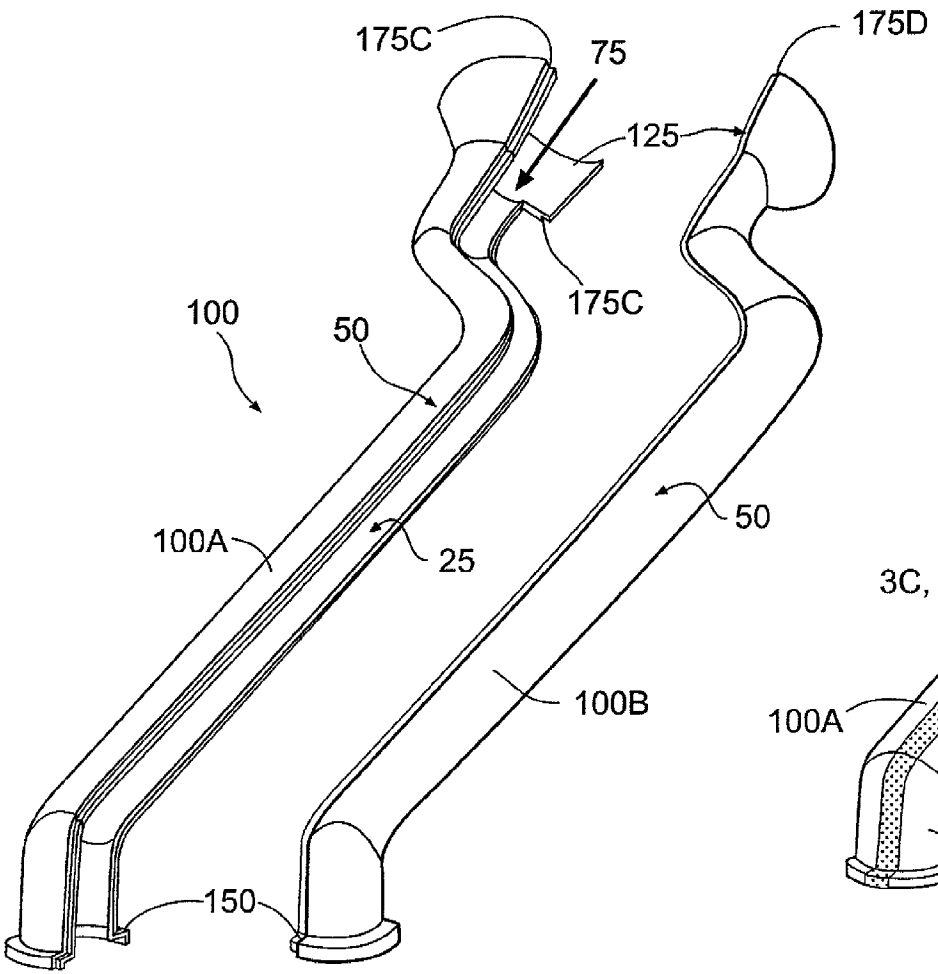
Figure 3D:
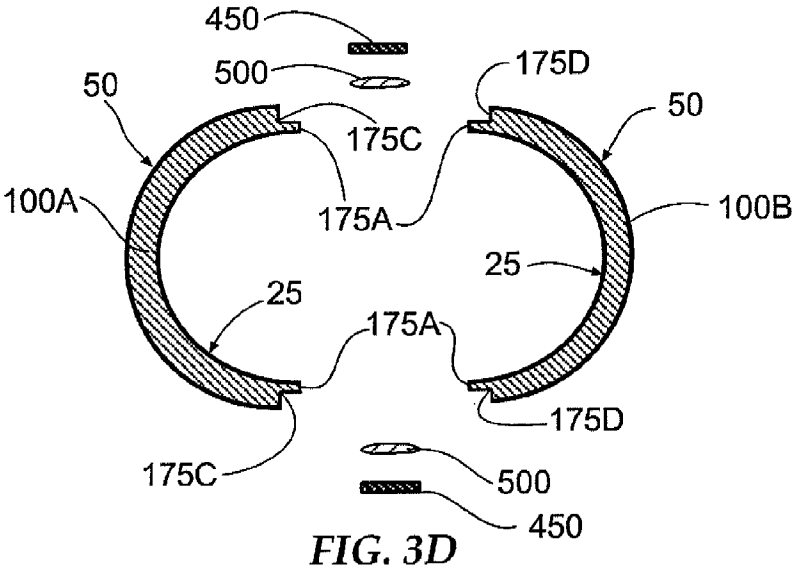
Figure 3E:
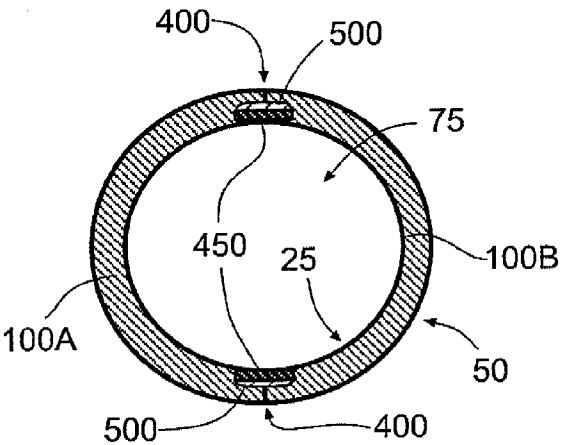
Figure 3C:
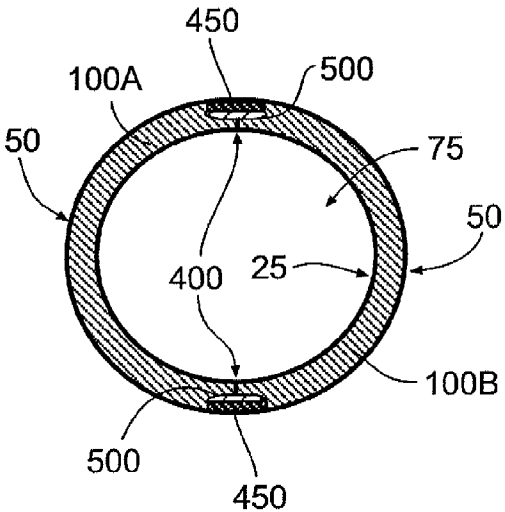

In alternative instances, as shown in FIGS. 3A-3E, the longitudinal edges 175A, 175B of the individual portions 100A, 100B of the manifold device 100 may define opposing recesses 175C, 175D along all or part of each seam. The recesses 175C, 175D may extend inwardly of the outer surface 50, as shown in FIGS. 3A, 3C, and 3D, and/or outwardly of the inner surface 25, as shown in FIG. 3E, such that, when the overmold member 450 is applied across the seam, the overmold member 450 is disposed within the recesses 175C, 175D, where the overmold member 450 is substantially flush with the external 50 (FIGS. 3B and 3C) and/or internal surface 25 (FIG. 3E) of the manifold device 100.

In some embodiments, the overmold member 450 may be comprised of, for example, a thermoplastic elastomer such as "Sanoprene™" or other suitable "soft touch" material. The overmold member 450, in one instance, configured to form a chemical bond with each of the individual portions 100A, 100B of the manifold device 100, on either side of complementary longitudinal edges 175A, 175B defining each seam, so as to provide the fluid-tight joints 400 therebetween. In such embodiments, an appropriate bonding material 500 such as, for example, a polypropylene/polyethylene material, a silicone-type bonding material, and/or any other suitable bonding material, may be disposed between the overmold member 450 and each of the portions 100A, 100B of the manifold device 100, across the seams, so as to provide the fluid-tight joints 400 from the inlet end 125 to the outlet end 150 of the interior channel 75.

Many modifications and other embodiments of the inventions set forth herein will come to mind to one skilled in the art to which these inventions pertain having the benefit of the teachings presented in the foregoing descriptions and the associated drawings. For example, the overmolding concepts discussed herein may also be applicable to other dishwasher components having a defined interior space, which are difficult (and possibly costly) to produce using a single-piece molding procedure, and/or would not provide the desired characteristics if formed using such a single-piece molding procedure, and would thus benefit by having that component formed in multiple pieces that are then joined together using an overmolding process. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tubular manifold device for a dishwasher, the manifold device having opposed inlet and outlet ends and defining a contiguous interior channel therebetween, the manifold device also having an inner surface defining the interior channel and an opposing outer surface, said manifold device comprising:

at least two discretely-formed manifold portions, each extending between and at least bisecting the opposed inlet and outlet ends of the interior channel, the at least two manifold portions being configured to cooperate to form an arcuate portion about the outlet end of the interior channel, with the outlet end being adapted to operably engage a spray arm mechanism, the arcuate portion being further configured to have one of a varying radius and a substantially constant radius for reducing a pressure drop of a fluid flow therethrough into the spray arm mechanism, the at least two discretely-formed manifold portions further being capable of cooperating via respective engagable longitudinal edges so as to form at least two joints therebetween; and at least one overmold member configured to sealingly engage the at least two manifold portions, across each of the at least two joints, such that the interior channel is fluid-tight between the inlet and outlet ends.

2. A manifold device according to claim 1 wherein the longitudinal edges of the at least two manifold portions are further configured such that the at least two joints are butt joints, and the at least one overmold member is further configured to sealingly engage at least one of the inner surface and the outer surface of the at least two manifold portions across the butt joints.

3. A manifold device according to claim 1 wherein the longitudinal edges of the at least two manifold portions are further configured to define complementarily configured recess portions such that the at least two joints are butt joints defining a recess with respect to at least one of the inner surface and the outer surface, and the at least one overmold member is further configured to sealingly engage each of the at least two manifold portions, within the recess defined by the at least two manifold portions and across the butt joints, such that the overmold member is substantially flush with the at least one of the inner surface and the outer surface.

4. A manifold device according to claim 1 wherein the overmold member is comprised of a thermoplastic elastomer.

5. A manifold device according to claim 1 wherein the at least two manifold portions are comprised of a thermoplastic elastomer.

6. A manifold device according to claim 1 wherein the at least two manifold portions are comprised of a polypropylene material.

7. A manifold device according to claim 1 further comprising a sealing material disposed between and configured to operably engage each of the at least two manifold members and the at least one overmold member so as to form a fluid-tight seal therebetween.

8. A method of forming a tubular manifold device for a dishwasher, the manifold device having opposed inlet and outlet ends and defining a contiguous interior channel therebetween, the manifold device also having an inner surface defining the interior channel and an opposing outer surface, said method comprising:

operably engaging respective longitudinal edges of at least two discretely-formed manifold portions so as to form at least two joints therebetween, each manifold portion extending between and at least bisecting the opposed inlet and outlet ends of the interior channel, and the at least two manifold portions being configured to cooperate to form an arcuate portion about the outlet end of the interior channel, with the outlet end being adapted to operably engage a spray arm mechanism, the arcuate portion being further configured to have one of a varying radius and a substantially constant radius for reducing a pressure drop of a fluid flow therethrough into the spray arm mechanism; and sealingly engaging at least one overmold member with each of the at least two manifold portions, across each of the at least two joints, such that the interior channel is fluid-tight between the inlet and outlet ends.

9. A method according to claim 8 wherein operably engaging the longitudinal edges further comprises operably engaging the longitudinal edges of the at least two manifold portions such that the at least two joints are butt joints, and wherein sealingly engaging the at least one overmold member further comprises sealingly engaging the at least one overmold member with at least one of the inner surface and the outer surface of the at least two manifold portions and across the butt joints.

10. A method according to claim 8 wherein operably engaging the longitudinal edges further comprises operably engaging the longitudinal edges of the at least two manifold portions, the at least two manifold portions further defining complementarily configured recess portions, such that the at least two joints are butt joints defining a recess with respect to at least one of the inner surface and the outer surface, and wherein sealingly engaging the at least one overmold member further comprises sealingly engaging the at least one overmold member with each of the at least two manifold portions, within the recess defined by the at least two manifold portions and across the butt joints, such that the at least one overmold member is substantially flush with the at least one of the inner surface and the outer surface.

11. A method according to claim 8, wherein sealingly engaging at least one overmold member with each of the at least two manifold portions further comprises applying a sealing material between each of the at least two manifold members and the at least one overmold member so as to form a fluid-tight seal therebetween.

* * * * *